US007181947B2

(12) United States Patent
Caporusso et al.

(10) Patent No.: US 7,181,947 B2
(45) Date of Patent: Feb. 27, 2007

(54) BENDING MACHINE WITH A COMPACT BEND ARM

(75) Inventors: Alessandro Caporusso, Piedimonte San Germano (IT); Mario Giorgio, Piedimonte San Germano (IT)

(73) Assignee: CML International S.p.A., San Germano (IT)

( * ) Notice: Subject to any disclaimer, the term of this patent is extended or adjusted under 35 U.S.C. 154(b) by 0 days.

(21) Appl. No.: 11/344,120

(22) Filed: Feb. 1, 2006

(65) Prior Publication Data

US 2006/0174673 A1 Aug. 10, 2006

(30) Foreign Application Priority Data

Feb. 4, 2005 (IT) ..... RM2005A0048

(51) Int. Cl.
*B21D 7/04* (2006.01)

(52) U.S. Cl. ..... 72/156; 72/149

(58) Field of Classification Search ..... 72/149, 72/150, 154, 155, 156, 217
See application file for complete search history.

(56) References Cited

U.S. PATENT DOCUMENTS 2,306,223 A * 12/1942 Parker et al. ..... 72/1
2,777,500 A 1/1957 Ekholm et al.
3,156,287 A * 11/1964 Munro ..... 72/17.2
3,287,952 A * 11/1966 Van Harten ..... 72/150

FOREIGN PATENT DOCUMENTS

JP 10-128631 5/1998
JP 2004-141891 5/2004

* cited by examiner

*Primary Examiner*—Dmitry Suhol
(74) *Attorney, Agent, or Firm*—Young & Thompson

(57) ABSTRACT

A bending machine with a compact bend arm includes in a bend arm (4) being mounted on a rotating spindle (3) a cylinder which is fed with a pressured fluid through hoses (7) being part of a hydraulic circuit connected to a source of pressured fluid and of an electric circuit. Each of the hoses (7), which are side by side, comprises a curved section (7*a*) around the rotating spindle (3), the curved section (7*a*) being radiused at one end to a section (7*b*) parallel to the bend arm (4), and at the other end to a section (7*c*) directed to the rest of the bending machine, to which hoses (7) are retained. In the section (7*b*) parallel to the bend arm (4) the plurality of hoses (7) are clamped on a slider (9) slidable in a prismatic guide (10) which is provided in the bend arm (4).

3 Claims, 3 Drawing Sheets

BENDING MACHINE WITH A COMPACT BEND ARM

FIELD OF THE INVENTION

The present invention relates to a bending machine with a compact bend arm.

BACKGROUND OF THE INVENTION

Bending machines have a bending device comprising a bend die or matrix and a bend arm both able to turn around on an axis and being provided with co-operating counter-acting members. These counteracting members clamp a section of a workpiece immediately after the section to be bent, according to a feeding direction of the workpiece in the bending machine. The workpiece is bent by causing both the matrix and the bend arm to move around the axis from an initial position to an end position. When a bending operation ends, the matrix is caused to return to the initial position.

In fixed radius bending machines such counteracting members comprise clamping jaws.

In order to allow workpieces to be bent into small radius curves and with various tilts, it should be desirable that a bending machine has a small size bending device. Further, it should be realized that the risk that certain bending operations cannot be performed, because they are hindered by parts of the bending device or of the rest of the bending machine, must be greatly reduced. Among such parts that would interfere with a bending operation there are both hoses of a hydraulic feeding circuit for cylinders situated on the bend arm, and wires of an electric circuit.

SUMMARY OF THE INVENTION

An object of the present invention is to allow bending operations to be performed without any hindrance or obstacle of hoses of a hydraulic feeding circuit and electric wires.

A further object of the invention is to improve the reliability of a bending machine operation.

Therefore, in order to achieve the above objects the invention provides a bending machine with a compact bend arm, including in a bend arm being mounted on a rotating spindle at least a double-acting cylinder which is fed with a pressured fluid through a plurality of hoses being part of a hydraulic circuit connected to a source of pressured fluid and of an electric circuit, each of the hoses, which are side by side, comprising a curved section around the rotating spindle, the curved section being radiused at one end to a section parallel to the bend arm, and at the other end to a section directed to the rest of the bending machine, to which the plurality of hoses are retained; in the section parallel to the bend arm the plurality of hoses being clamped on a slider slidable in a prismatic guide which is provided in the bend arm.

BRIEF DESCRIPTION OF THE DRAWINGS

The present invention will be described referring to a preferred embodiment thereof in connection with the enclosed drawings, in which.

DETAILED DESCRIPTION OF A PREFERRED EMBODIMENT

Figure 1:
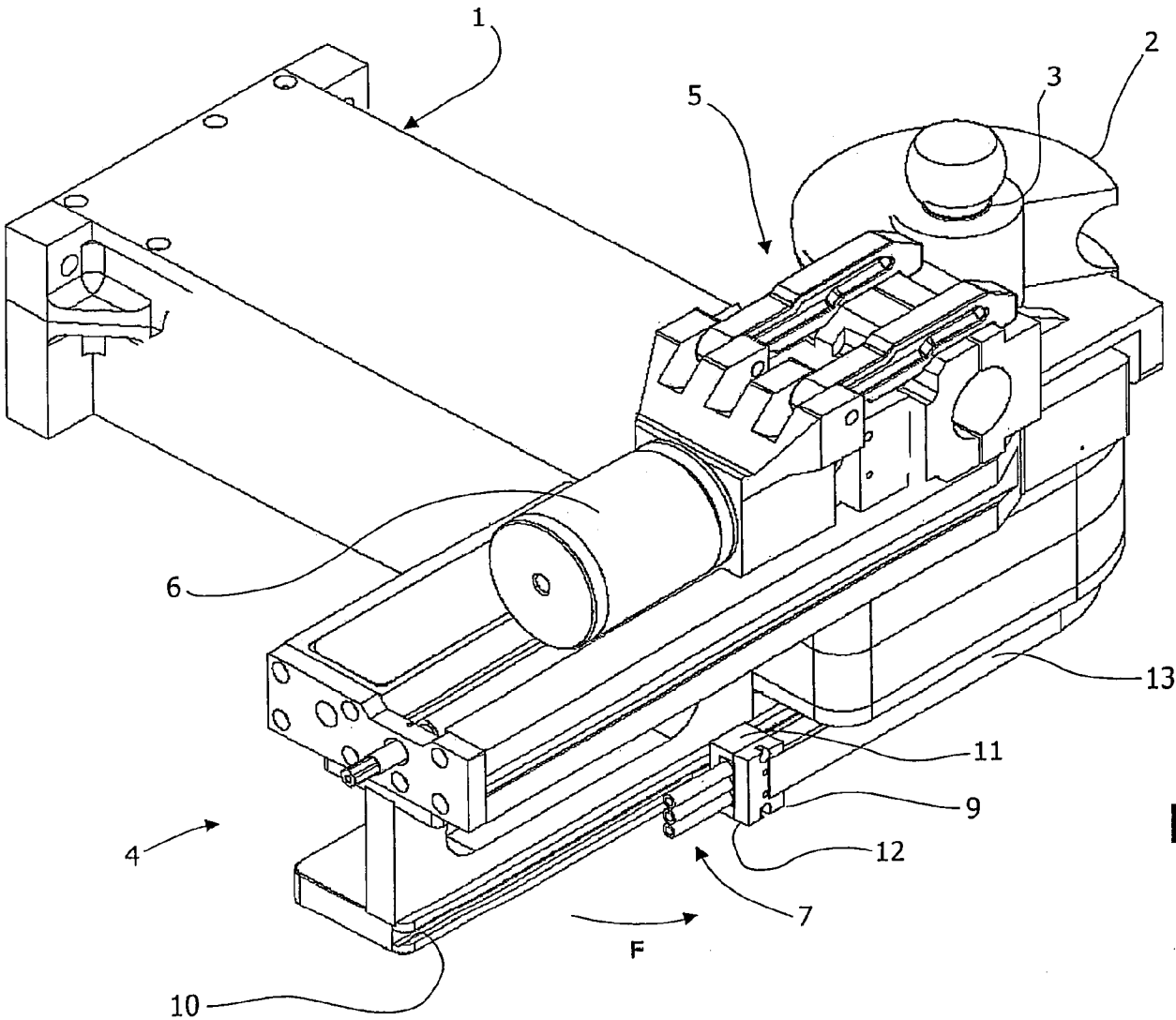
FIG. 1 shows a fragmentary perspective view of a bending machine in which the present invention is embodied, only a matrix and a bend arm of the bending machine being represented in an initial position of bending operation.

With reference to the drawings, in FIG. 1 there is shown a bending machine in a fragmentary perspective view. On a support bench 1 which is connected to the rest of the bending machine (not shown), a bend die or matrix 2 is mounted around a rotating spindle 3, and a bend arm generally indicated as 4, is mounted around the same rotating spindle 3. A vise 5 using a double-acting cylinder 6 to clamp a section of a pipe to be bent (not shown) in its start or initial bending position is situated on the bend arm 4. After a set angle rotation of the rotating spindle 3 by driving means (not shown), a bending pipe operation on the matrix is performed for a pipe section corresponding to said set angle.

Two hoses feeding a pressured fluid for the double-acting cylinder 6 and a hose for wires of an electric circuit are shown in FIG. 1 and generally indicated as 7. Of course, the plurality of hoses can be different from a number of three. For clarity sake, hoses 7 are shown as cut. However, it should be understood that they extend to the double-acting cylinder 6 and other served parts.

According to the invention, hoses 7 have a feature that they do not remain hanging from the bend arm 4, as in prior art bending machines. In such a way there are not dangerous hindrances or obstacles to a bending operation, since, as explained below, hoses 7 are kept adjoined to the bend arm 4.

Figure 2:
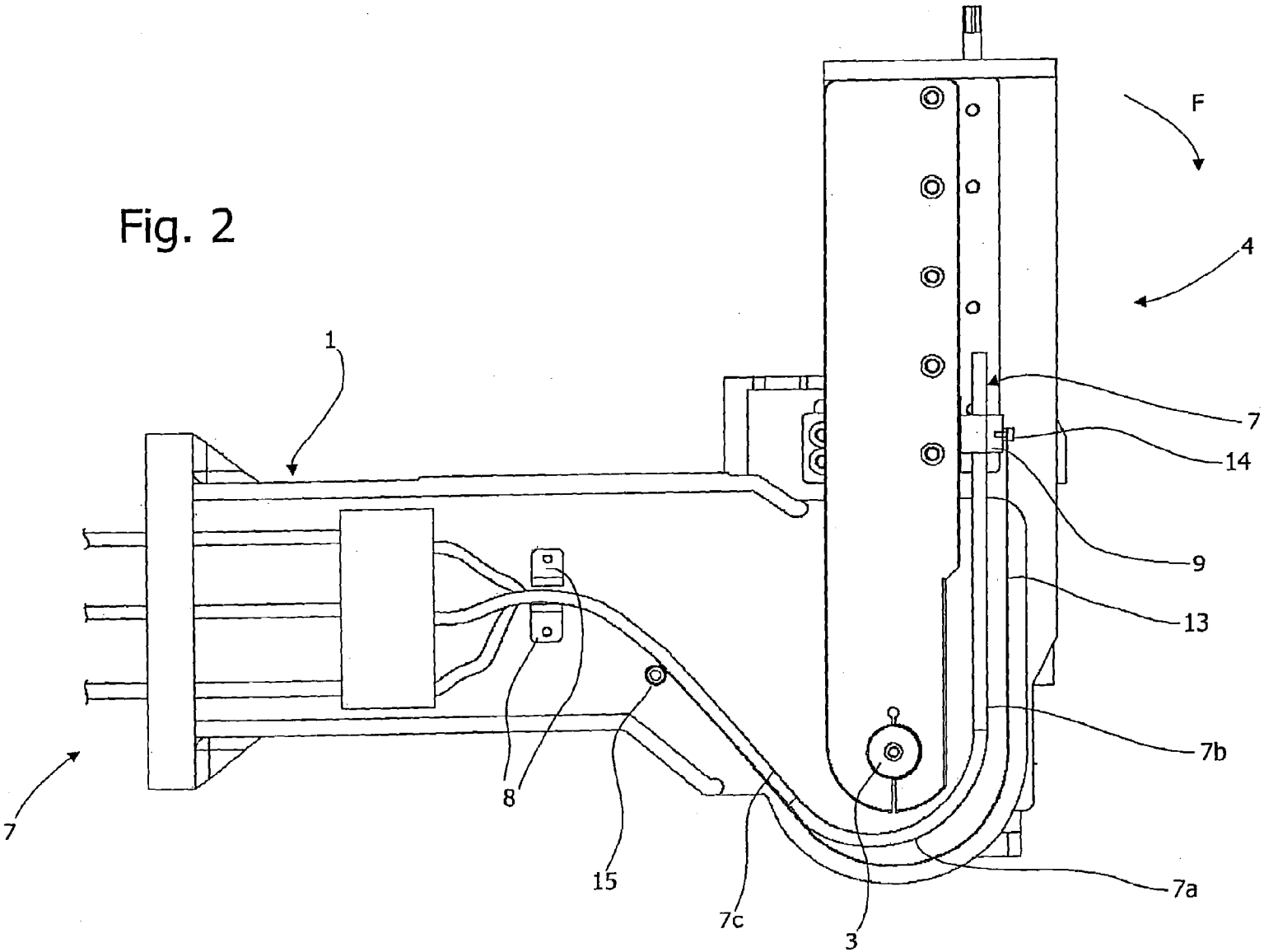
FIG. 2 shows a bottom plan view of the bending machine in FIG. 1.

As best seen in FIG. 2, which is a fragmentary bottom plan view of the bending device, hoses 7 are arranged in a generally parallel, preferably side by side vertical relationship, i.e. beside the bend arm 4.

As mounted on the bend arm 4, hoses 7 have a curved section 7*a* with a concavity facing the rotating spindle 3. The curved section 7*a* is radiused at one end thereof to a section 7*b* parallel to the bend arm 4, and at the other end to a section 7*c* respectively, directed to the rest of the bending machine.

Figure 3:
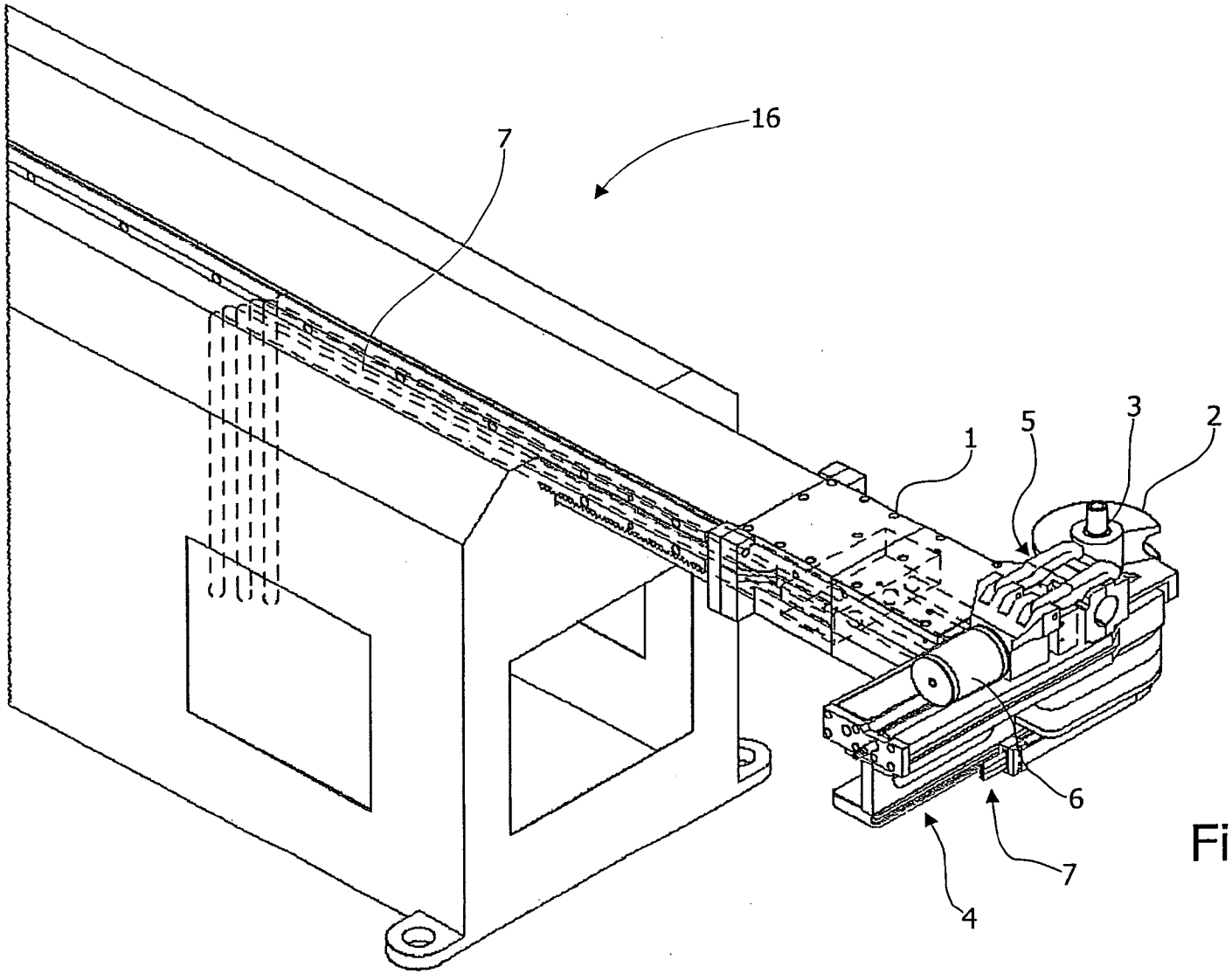
FIG. 3 shows a fragmentary perspective view of a bending machine in which the present invention is embodied, with the matrix and the bend arm being positioned in the initial bending operation.

As seen in FIG. 3, which is a fragmentary perspective view, shown inside the bending machine are hoses which are retained at least in a point of the bending device, e.g. by two brackets 8, 8 facing each other (FIG. 2). In their section 7*b* parallel to the bend arm 4, hoses 7 are clamped by a slider 9 slidable in a prismatic guide 10 (FIG. 1) which is provided on the bend arm 4 in an external lateral underside thereof, toward an arrow F indicating a direction in which the bend arm 4 rotates from its start position shown in FIG. 1.

The slider 9 has an U-shaped base plate 11, which is provided in its bottom with engagement projections (not shown) for a slidable joint with the prismatic guide 10, and a closure element 12 adapted to be fixed by screws to sides of the U-shaped base plate 11 to enclose and clamp the hoses 7.

A protective flexible tape member 13 is provided opposite the bending machine beside the hoses 7. The protective flexible tape member 13 is fixed at one end to the slider 9, e.g. by a screw 14 (FIG. 2) and at the other end thereof is constrained to swing around a sliding guide in the form of a pin 15 on which also hoses 7 abut laterally. Advantageously the flexible tape member 13 is made of a spring steel.

In the operation of the bending machine, the bend arm 4 is rotated in the direction of the arrow F to bend a pipe which is clamped by the vice 5. When the bend arm 4 rotates, hoses 7 being retained by brackets 8, 8 underneath the support bench 1 are caused to extend parallel to a side of the bend arm 4. Hoses 7 really extend but without projecting downward from the bend arm 4, since they are clamped by the slider 9 slidable in the prismatic guide 10. The protective flexible tape member 13 protects hoses 7 as well as helps the slider 9 slide in the prismatic guide 10.

In such a way the bend arm 4 does not rise in its bulkiness in the pipe bending operation, and there is no risk that hoses of the hydraulic circuit are caught by a pipe while being bent. It should be appreciated that in such a way the reliability of the operator of the bending machine is more improved. As shown in FIG. 3, hoses 7 continue inside the bending machine through an extension of its support bench 1 to both a source of pressured fluid and a hydraulic unit that are not described in detail.

The invention has been described by way of example, and variations and changes can be made without departing from the scope of the enclosed claims.

What is claimed is:

1. A bending machine with a compact bend arm, including in a bend arm being mounted on a rotating spindle at least a double-acting cylinder which is fed with a pressured fluid through a plurality of hoses being part of a hydraulic circuit connected to a source of pressured fluid and of an electric circuit, characterized in that each of the hoses, which are side by side, comprises a curved section around the rotating spindle, the curved section terminating at one end in a section parallel to the bend arm, and at the other end in a section directed to the rest of the bending machine, to which the plurality of hoses are retained; in the section parallel to the bend arm the plurality of hoses being clamped on a slider slidable in a guide which is provided in the bend arm, and a protective flexible tape member attached opposite the bending machine beside the plurality of hoses, the protective flexible tape member being fixed at one end to said slider, and at the other end thereof being constrained to abut against a sliding guide of the plurality of hoses.

2. The bending machine according to claim 1, characterised in that the protective flexible tape member is made of a spring steel.

3. The bending machine according to claim 1, characterised in that the hoses of the plurality of hoses are in a side by side, vertical relationship in the bend arm.

* * * * *